US007070320B2

(12) United States Patent
Schmiedchen et al.

(10) Patent No.: US 7,070,320 B2
(45) Date of Patent: Jul. 4, 2006

(54) MECHANISM FOR TRIGGERING A STRIKING WORK FOR A TIMEPIECE FITTED WITH A TIMER

(75) Inventors: Christian Schmiedchen, Reichstädt (DE); Mathias Schneider, Heidenau (DE); Patrick Streubel, Heidenau (DE)

(73) Assignee: Glashütter Uhrenbetrieb GmbH, Glashütte/Sachsen (DE)

( * ) Notice: Subject to any disclaimer, the term of this patent is extended or adjusted under 35 U.S.C. 154(b) by 311 days.

(21) Appl. No.: 10/472,471

(22) PCT Filed: Mar. 21, 2001

(86) PCT No.: PCT/EP01/03345

§ 371 (c)(1),
(2), (4) Date: Sep. 22, 2003

(87) PCT Pub. No.: WO02/077722

PCT Pub. Date: Oct. 3, 2002

(65) Prior Publication Data

US 2004/0090870 A1 May 13, 2004

(51) Int. Cl.
*G04F 3/00* (2006.01)

(52) U.S. Cl. ..... 368/98; 368/244

(58) Field of Classification Search ..... 368/74, 368/75, 97–100, 139, 140, 145, 31, 43, 185, 368/244, 243
See application file for complete search history.

(56) References Cited

U.S. PATENT DOCUMENTS

| | | | | |
|---|---|---|---|---|
| 2,113,274 | A * | 4/1938 | Lux | 368/99 |
| 2,554,402 | A * | 5/1951 | Ditisheim | 368/74 |
| 3,086,352 | A * | 4/1963 | Jaccard | 368/244 |
| 3,323,303 | A * | 6/1967 | Jaccard | 368/100 |
| 3,460,339 | A * | 8/1969 | Schneider | 368/247 |

FOREIGN PATENT DOCUMENTS

| | | | |
|---|---|---|---|
| CH | 372989 | * | 11/1959 |
| CH | 372 989 | | 7/1963 |
| CH | 12 101/64 | | 5/1967 |
| DE | 199 12 320 A1 | | 9/1999 |
| DE | 19912320 A1 | * | 9/1999 |
| FR | 783 990 | | 7/1935 |

OTHER PUBLICATIONS

Translation of DE19912320A1.*
Translation of CH372989.*
International Search report completed Aug. 3, 2001 and mailed Aug. 10, 2001 in PCT/EP 01/03345.

* cited by examiner

*Primary Examiner*—Kamand Cuneo
*Assistant Examiner*—Jeanne-Marguerite Goodwin
(74) *Attorney, Agent, or Firm*—Griffin & Szipl, P.C.

(57) ABSTRACT

The mechanism (9) for triggering a striking work, is disposed between a timer (11), which is used to countdown and to display a pre-determined time interval on a dial, and a strike train (14) in order to make said striking work heard when the timer has counted down completely. The mechanism essentially comprises a lever (1) which is fitted with a leaf spring (3) and a locking stone (2).

9 Claims, 3 Drawing Sheets

MECHANISM FOR TRIGGERING A STRIKING WORK FOR A TIMEPIECE FITTED WITH A TIMER

This is a National Phase Application in the United States of International Patent Application No. PCT/EP01/03345 filed Mar. 21, 2001. The entire disclosure of the above patent application is hereby incorporated by reference.

FIELD OF THE INVENTION

The present invention relates to a mechanism for triggering a striking work fitted to a timepiece, the latter including a strike train actuated by a barrel.

BACKGROUND OF THE INVENTION

Timepieces fitted with a mechanism triggering a striking work from a strike train actuated by a barrel are well known in the state of the art. It is mainly timekeepers striking the hour, half-hour and quarter-hour at the user's demand, when he actuates a push-button fitted to the timepiece. In more complicated timepieces, called repeater watches, it is even possible to strike the minutes.

However, to the Applicant's knowledge, there has never been proposed a striking work that alerts the person wearing the timepiece at the end of a countdown of a period stored in a timer.

SUMMARY OF THE INVENTION

In order to fill this gap, the present invention is characterised in that the mechanism for triggering the striking work is arranged between a timer for counting down and displaying on a dial a predetermined time interval, and the strike train for making said striking work heard when the timer reaches the end of the countdown.

BRIEF DESCRIPTION OF THE DRAWINGS

The invention will now be explained in detail hereinafter by an embodiment given by way of example, this embodiment being illustrated by the annexed drawings, in which.

DETAILED DESCRIPTION OF THE INVENTION

Figure 1:
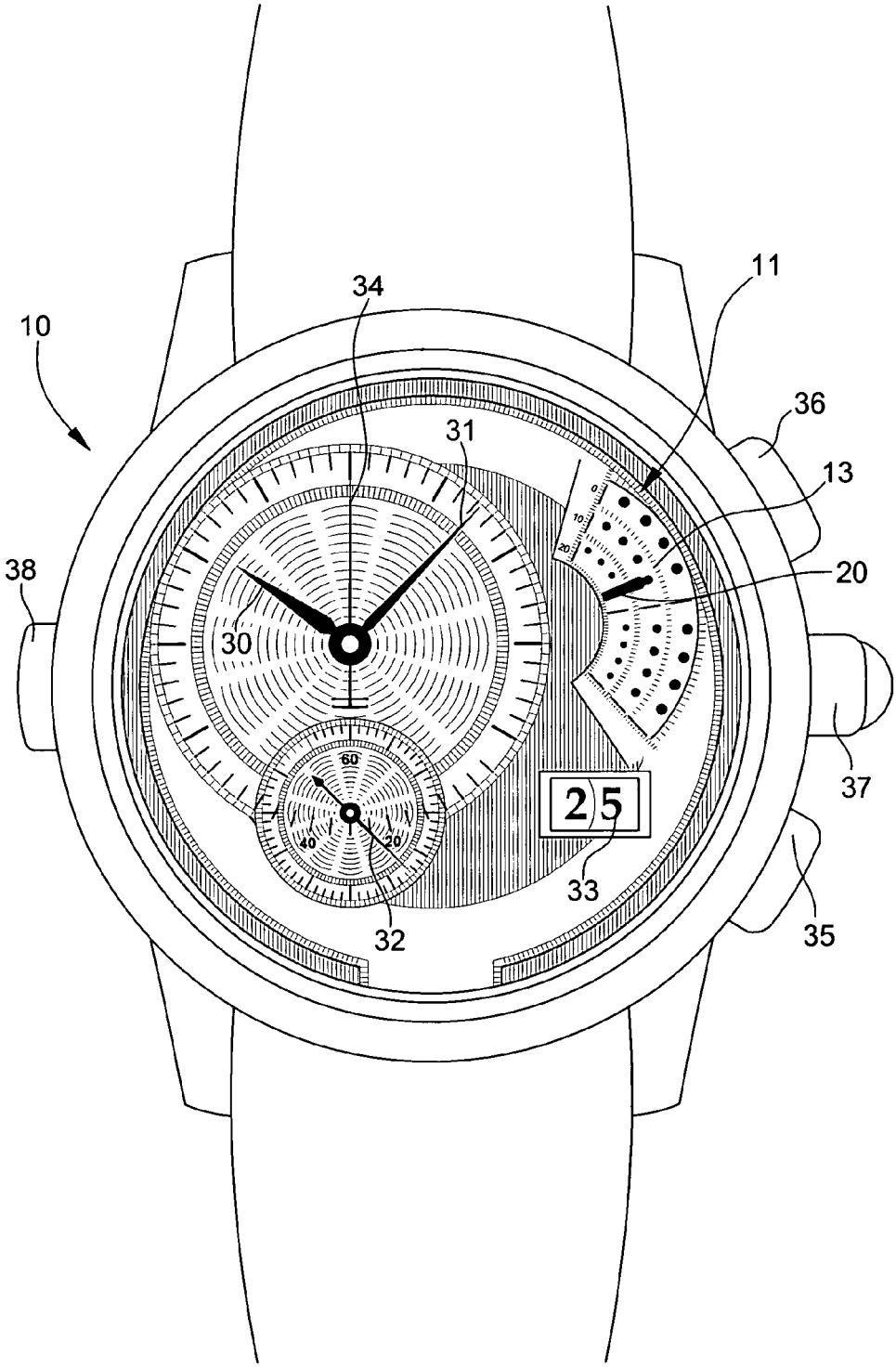
FIG. 1 is a plan view of the timepiece containing the invention.

FIG. 1 is a plan view of timepiece 10 containing the invention. This timepiece includes timekeeping hands, namely an hour hand 30, a minute hand 31 and a small second hand 32. A large aperture date device 33 completes the timepiece. The timepiece taken by way of example here further includes a chronograph function with a second hand 34 and a minute counter 11. Hand 34 and counter 11 are started and stopped by means of a first push-button 35, whereas a second push-button 36 resets said indicators 34 and 11 to zero. A crown 37, depending upon the axial positions into which it is brought, allows the timepiece to be wound, the date to be set and the timekeeper to be set to the correct time.

In the timepiece taken as an example, minute counter 11 is also used as a timer or countdown counter 11, the setting of the period to be counted down being conferred on crown 37. The timer is started and a barrel actuating a striking work indicating the end of the countdown is wound by pressing on a third push-button 38. As FIGS. 1 and 2 show, counter-timer 11 includes a dial 13 containing three concentric scales, each of ten minutes, and over each of which a hand of different length 19, 20 and 21, travels.

Figure 2:
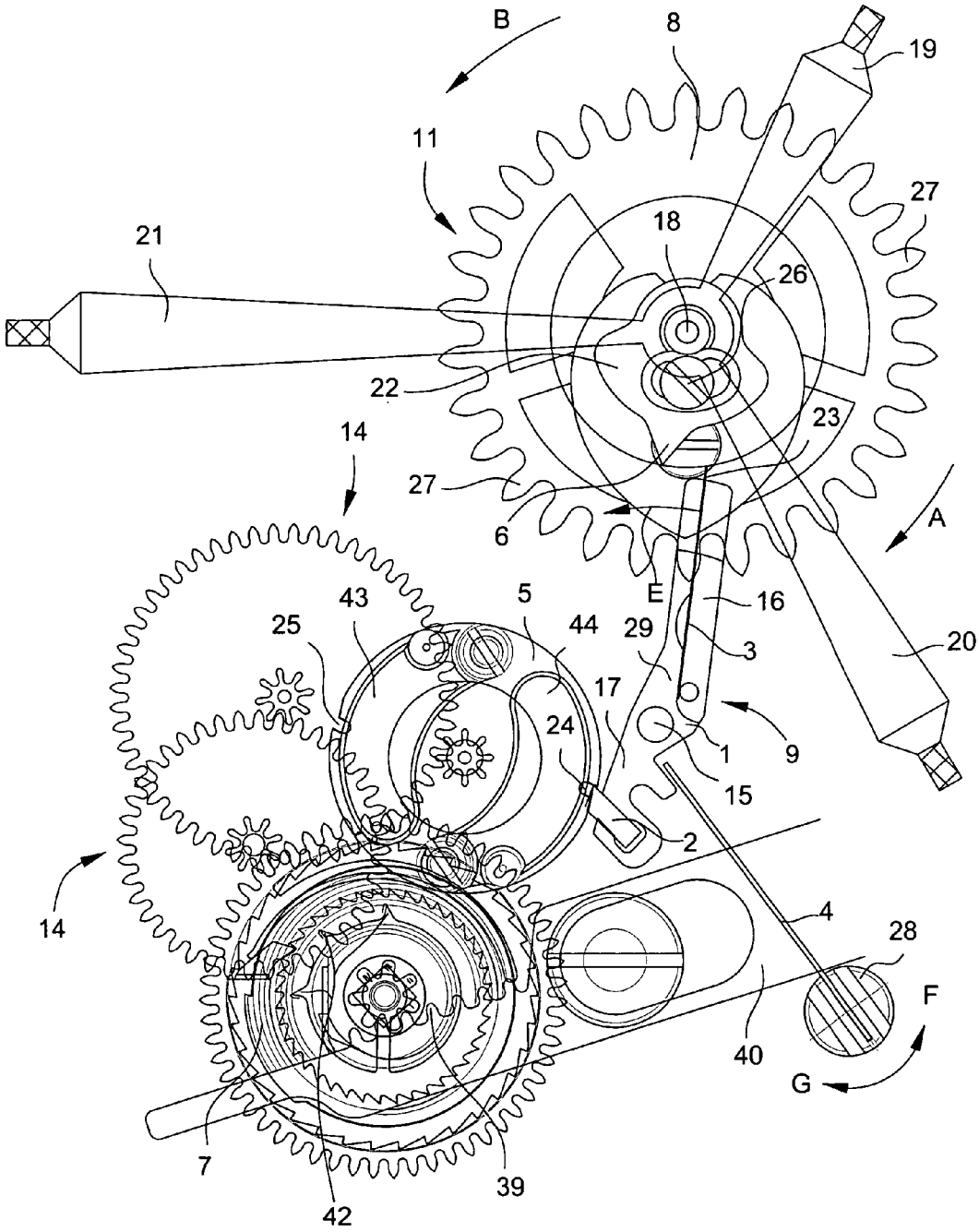
FIG. 2 is a plan view of the trigger mechanism according to the invention, the mechanism being located between a timer and a strike train.

As FIG. 2 shows, the timepiece includes a strike train 14 actuated by a barrel 7. Barrel 7 is wound by a rack 39 made on a bar 40 ending (see FIG. 1) in push-button 38. The barrel 7 assembly, which will not be described in detail here, carries points 42, which actuate a striking hammer (not shown). This assembly drives strike train 14, which here includes three wheel sets, including end wheel set 5.

According to the invention, a striking work trigger mechanism 9 is arranged between timer 11 for counting down and displaying on dial 13 (see FIG. 1) a predetermined time interval and strike train 14 for allowing said striking work to be heard when timer 11 reaches the end of the countdown.

As can be clearly seen in FIG. 2, trigger mechanism 9 includes a lever 1. This lever includes a pivoting shaft 15 and first and second portions 16 and 17 located on either side of shaft 15. First portion 16 is arranged to be actuated by timer 11 when the latter reaches the end of the countdown. Second portion 17 is arranged to lock strike train 14 during the countdown and to unlock said train when said timer reaches the end of said countdown.

Figure 3:
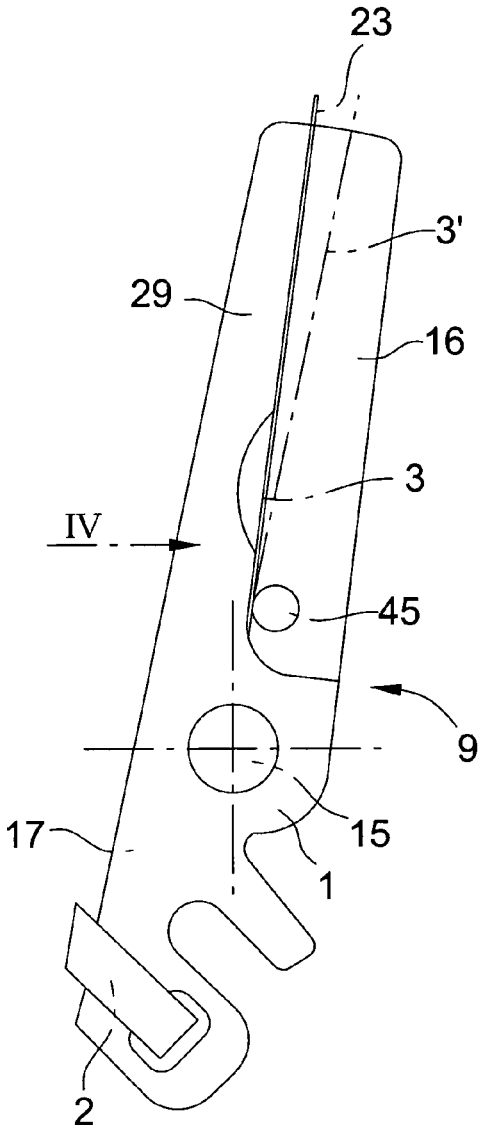
FIG. 3 is an enlarged view of a lever forming the main part of the trigger mechanism.
Figure 4:
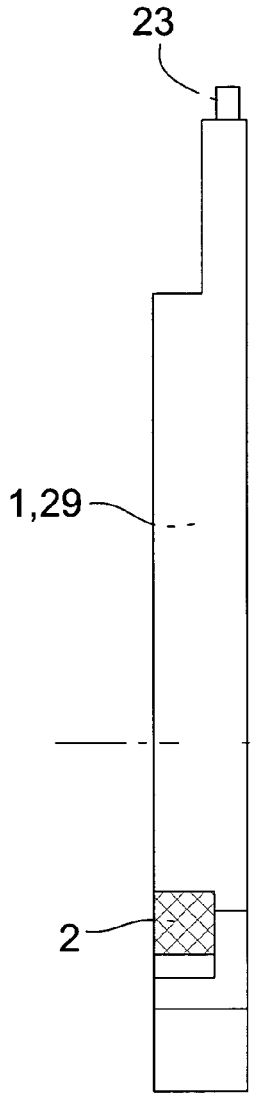
FIG. 4 is a view along the arrow IV shown in FIG. 3.

One way of making this trigger mechanism will now be described in detail. Reference will be made for this purpose to FIGS. 2, 3 and 4.

Timer 11 essentially includes a minute wheel 8 making one revolution in thirty minutes. This wheel is set to the desired time by crown 37 of the timepiece in accordance with a process that will not be described here. The set of hands 19, 20 and 21, displaying the selected time interval, are mounted onto shaft 18 of wheel 8, as mentioned hereinbefore. At the moment when third push-button 38 is pushed (see FIG. 1), barrel 17 is wound and the countdown process is started, wheel 8 then meshing with the movement of the timepiece, in accordance with a mechanism that is not shown in FIG. 2. Wheel 8 then rotates in the direction of arrow, A which is a counting down direction.

It will be observed here that the mechanism shown in FIG. 2 is seen from underneath the timepiece, which explains why the direction of arrow A is the opposite of the counting down direction shown in FIG. 1, where the timepiece is seen from above.

Wheel 8 carries a plate 22 provided with a beak 6 and the first portion 16 of lever 1 carries a leaf spring 3 one end 23 of which is able to be contacted by beak 6 of plate 22. The second portion 17 of lever 1 carries a locking stone 2 co-operating with a notch 24 made in an end mobile 5 of strike train 14.

During the countdown, beak 6 of plate 22 is not in contact with end 23 of leaf spring 3, and stone 2 is engaged in notch 24 of mobile 5, thus locking strike train 14. It will be observed here that stone 2 is held engaged in notch 24 via the effect of a leaf spring 4, which presses on second portion 17 of lever 1, this pressing force being able to be adjusted by an adjustment device 28. By rotating device 28 in a direction F or G, this pressing force is respectively increased or decreased.

When timer 11 reaches the end of the countdown, beak 6 of plate 22 meets end 23 of leaf spring 3 and drives lever 1 in rotation, which has the effect of releasing stone 2 from notch 24. The strike train is thus released and points 42 forming part of the barrel 7 assembly start to rotate, which actuates the strike hammer as previously described. It will be noted here that a single point would be sufficient to emit a single sound. However, an arrangement of three points generating three brief, close sounds was preferred. It will also be noted that the force necessary to trigger the mechanism is very slight owing to the proposed device.

It will also be mentioned that end wheel set 5 of strike train 14 is a centrifugal governor which limits the rotational speed of the gear train and which acts as a brake on the kinematic chain. For this purpose, wheel set 5 carries two inertia blocks 43 and 44, which move apart when wheel set 5 is driven in rotation.

Plate 22 carrying beak 6 can be adjusted angularly with respect to minute wheel 8. This adjustment can occur by means of a screw 26. It will be understood that beak-trigger 6 has to be oriented with respect to toothing 27 of wheel 8 if one wishes to make the moment that the striking work is triggered coincide exactly with the zero indication shown on timer dial 13.

FIGS. 3 and 4 shown an enlargement of the lever 1, shown in FIG. 2 in context. It can be seen that the leaf spring is mounted abutting against a shoulder 29 made in the first portion 16 of lever 1 and held in this position by a pin 45. One can see again in these Figures end 23 of the leaf spring, representing the place contacted by beak 6 associated with minute wheel 8. Owing to this arrangement of the leaf spring, it is clear that minute wheel 8 can have two roles: that of timer for a countdown triggering the striking work at the end of the countdown, and that of the minute counter of a chronograph.

In the timepiece taken as an example, the countdown drives minute wheel 8 and beak 6, which is associated with it, in a direction A (clockwise). In this situation, when the beak contacts leaf spring 3, and more precisely end 23 of this leaf spring, the latter cannot bend as it is pressed against shoulder 29 of lever 1, which drives the lever in rotation and triggers the striking work mechanism.

When minute wheel 8 is driven in an opposite direction B (anti-clockwise) to that which it takes when counting down, particularly when it is used as a chronograph minute counter, leaf spring 3 will bend as shown at reference 3' in FIG. 3 and allow beak 6 to pass without any deterioration of the mechanism. An identical situation occurs when, by means of crown 37, the time to be counted down is fixed and the zero on dial 13 is, for example, passed several times.

The invention claimed is:

1. A mechanism for triggering a striking work fitted to a timepiece, the later including a strike train actuated by a barrel, wherein the trigger mechanism is arranged between a timer for counting down and displaying on a dial a predetermined time interval, and the strike train for making a striking work heard when the timer reaches an end of a countdown;

further including a lever inserted between the timer and the strike train, the lever including a pivoting shaft and first and second portions located on either side of the shaft, the first portion being arranged to be actuated by the timer when the latter reaches the end of the countdown and the second portion being arranged to lock the strike train during the countdown and to unlock the strike train when the timer reaches the end of the countdown;

wherein the timer includes a minute wheel on the shaft on which is mounted a set of hands displaying the time interval, the wheel carrying a plate provided with a beak, in that the first portion of the lever carries a leaf spring, one end of which is capable of being contacted by the beak of the plate to drive the lever in rotation, and wherein the second portion of the lever carries a locking stone co-operating with a notch made in a wheel set of the strike train to lock the latter during the countdown.

2. A mechanism according to claim 1, wherein the plate is fixed to the minute wheel by a screw allowing the beak of said plate to be oriented with respect to the toothing of the wheel.

3. A mechanism according to claim 1, wherein the stone carried by the second portion of the lever is held in the notch of the wheel set of the strike train by means of a leaf spring pressing on said second portion.

4. A mechanism according to claim 3, wherein an adjustment device is implemented on the leaf spring to adjust the pressure thereof on the second portion of the lever.

5. A mechanism according to claim 1, wherein said wheel set of the strike train comprises a centrifugal governor located at the end of said strike train.

6. A mechanism according to claim 1, wherein the countdown drives the minute wheel and the beak which is associated with it in a direction such that, when the beak contacts the leaf spring, the latter is arranged not to bend, which drives the lever in rotation and triggers the striking work mechanism.

7. A mechanism according to claim 1 wherein when the minute wheel is driven in an opposite direction to that which it has when it is counting down the leaf spring is arranged to bend when the beak associated with the wheel contacts said leaf, such that the lever allows the beak to pass without forcing the mechanism.

8. A mechanism according to claim 6, wherein the leaf spring abuts against a shoulder made in the first portion of the lever, the end of said leaf spring exceeding said first portion, said end representing the place contacted by the beak associated with the minute wheel.

9. A mechanism according to claim 7, wherein the leaf spring abuts against a shoulder made in the first portion of the lever, the end of said leaf spring exceeding said first portion, said end representing the place contacted by the beak associated with the minute wheel.

* * * * *